US011492797B2

(12) United States Patent
Recker et al.

(10) Patent No.: US 11,492,797 B2
(45) Date of Patent: Nov. 8, 2022

(54) CONNECTOR FOR PRECAST CONCRETE STRUCTURES

(71) Applicant: Meadow Burke, LLC, Riverview, FL (US)

(72) Inventors: Michael J. Recker, Palmetto, FL (US); Ronald G. Naumann, Valrico, FL (US)

(73) Assignee: MEADOW BURKE, LLC, Riverview, FL (US)

( * ) Notice: Subject to any disclaimer, the term of this patent is extended or adjusted under 35 U.S.C. 154(b) by 0 days.

(21) Appl. No.: 17/193,752

(22) Filed: Mar. 5, 2021

(65) Prior Publication Data

US 2021/0277650 A1 Sep. 9, 2021

Related U.S. Application Data

(60) Provisional application No. 62/985,441, filed on Mar. 5, 2020.

(51) Int. Cl.
*E04B 1/41* (2006.01)
*E04B 1/00* (2006.01)

(52) U.S. Cl.
CPC ..... *E04B 1/41* (2013.01)

(58) Field of Classification Search
CPC ..... E04B 1/41
USPC ..... 52/699
See application file for complete search history.

(56) References Cited

U.S. PATENT DOCUMENTS 693,127 A 2/1902 Gardner et al.
1,189,988 A 7/1916 Moody
1,201,540 A 10/1916 Banes
1,551,432 A 8/1925 Schaeffer
1,831,565 A * 11/1931 Jagger ..... E04B 1/4178 52/700
2,053,873 A 9/1936 Niederhofer
2,218,894 A 10/1940 Schlosser
2,336,604 A 12/1943 Edward et al.
(Continued)

FOREIGN PATENT DOCUMENTS

CA 2063095 9/1993
CA 2776394 5/2012
(Continued)

OTHER PUBLICATIONS

U.S. Appl. No. 29/720,068, filed Jan. 9, 2020, Kelly et al..
(Continued)

*Primary Examiner* — Brian D Mattei
*Assistant Examiner* — Joseph J. Sadlon
(74) *Attorney, Agent, or Firm* — Sheridan Ross P.C.

(57) ABSTRACT

A connector and a method of manufacturing a connector are provided for joining a precast concrete structure and a support structure such as a floor joist. An attachment member of the connector is assembled in a manner that allows forces to be transferred through a protrusion and aperture connection, which reduces the forces transferred through welded joints. As a result, the attachment member requires less welding and saves time and costs when installing the connector. In some embodiments, a support is secured to a horizontal plate which increases the rigidity of the horizontal plate and the ability of the horizontal plate to transfer forces from a support structure to a precast concrete structure.

20 Claims, 4 Drawing Sheets

(56) References Cited

U.S. PATENT DOCUMENTS 2,355,651 A 8/1944 Hormes
2,477,735 A 8/1949 Gentile
2,622,834 A 12/1952 Birger
2,660,050 A 11/1953 Hosbein et al.
2,681,786 A 6/1954 Birger
2,684,824 A 7/1954 Hillberg
2,832,559 A 4/1958 Hillberg
2,913,210 A 11/1959 Tichnor
2,940,603 A 6/1960 Riedmaier et al.
3,085,693 A 4/1963 Shell
3,171,627 A 3/1965 Tapley et al.
3,187,924 A 6/1965 William
3,229,950 A 1/1966 MacRobbie
3,273,847 A 9/1966 Berman
3,360,898 A * 1/1968 Beckman ..... E04C 5/18 52/684
3,471,988 A * 10/1969 Allen ..... E04B 1/2612 52/96
3,537,671 A 11/1970 Wenthe
3,604,669 A 9/1971 Asher
3,613,900 A 10/1971 Chiu
3,628,762 A 12/1971 Williams et al.
3,637,086 A 1/1972 Klein
3,652,048 A 3/1972 Hartman
3,700,202 A 10/1972 Donnels
3,701,325 A 10/1972 Fenwick
3,737,131 A 6/1973 Larson
3,776,555 A 12/1973 Hagaman
3,788,026 A 1/1974 Cook
3,798,856 A 3/1974 Glaskowski
3,829,153 A 8/1974 Fussell, Jr. et al.
3,858,988 A 1/1975 Cohen
3,888,441 A 6/1975 Rebentisch
3,896,718 A 7/1975 Giambalvo
3,915,308 A 10/1975 Ratszloff et al.
3,954,243 A 5/1976 Sharp et al.
4,083,156 A 4/1978 Tye
D254,290 S 2/1980 Smith
4,198,913 A 4/1980 Haworth et al.
4,378,925 A 4/1983 Griffin
4,403,700 A 9/1983 Manlove
4,528,915 A 7/1985 Cofer
4,532,740 A * 8/1985 Fricker ..... E04G 15/061 52/576
4,588,866 A 5/1986 Monti
4,615,448 A 10/1986 Johnstonbaugh
4,687,094 A 8/1987 Allsop et al.
D295,950 S 5/1988 Johnston
4,817,900 A 4/1989 Whittington et al.
4,835,933 A * 6/1989 Yung ..... E04C 5/168 52/685
4,850,453 A * 7/1989 St-Germain ..... E04G 5/04 52/513
4,872,634 A 10/1989 Gillaspy et al.
4,951,438 A 8/1990 Thoresen
5,038,689 A 8/1991 Duffy
5,114,127 A 5/1992 Everhart
5,150,553 A * 9/1992 Commins ..... E04B 1/41 52/712
5,154,388 A 10/1992 Magaro
5,185,971 A 2/1993 Johnson, Jr.
5,379,976 A 1/1995 Degirolamo
5,472,103 A 12/1995 Merl
5,548,939 A 8/1996 Carmical
5,711,122 A 1/1998 Lee
5,778,625 A * 7/1998 Druffel ..... H02G 3/20 52/576
5,881,519 A 3/1999 Newkirk
5,899,035 A 5/1999 Walkes et al.
5,943,830 A 8/1999 Truitt
6,019,331 A 2/2000 Hoogland et al.
6,101,773 A 8/2000 Chau et al.
6,212,848 B1 * 4/2001 Cooper ..... E04C 5/20 52/689
6,223,916 B1 5/2001 Enos
6,247,273 B1 6/2001 Nickel
6,273,435 B1 8/2001 Sringer
6,298,631 B1 * 10/2001 Finley ..... E04F 17/06 52/712
6,494,639 B1 12/2002 Friend
6,499,608 B1 12/2002 Sterling et al.
6,546,684 B2 4/2003 Wallkes et al.
6,672,226 B2 1/2004 Bohnacker
6,854,222 B2 2/2005 Hansort
6,951,433 B2 * 10/2005 Reichel ..... E04B 1/4157 403/373
D511,086 S 11/2005 Craine
D513,171 S 12/2005 Richardson
D521,851 S 5/2006 Smart
7,086,544 B1 8/2006 Doench
7,337,583 B1 * 3/2008 Lohman ..... E04H 3/123 52/9
7,681,366 B2 * 3/2010 De Gobbi ..... E04F 13/083 52/235
7,686,172 B2 3/2010 Wisnoski et al.
7,726,091 B2 * 6/2010 Frohlich ..... E04B 1/215 52/707
7,793,450 B2 9/2010 Chasmer et al.
8,186,645 B2 5/2012 Shaw et al.
8,209,924 B2 7/2012 Foley
8,209,925 B2 7/2012 Foley
8,365,484 B2 2/2013 Foley
8,468,764 B2 * 6/2013 Degen ..... E04B 2/8635 52/489.1
D701,107 S 3/2014 White
D706,321 S 6/2014 Oetlinger
8,746,633 B1 * 6/2014 Medlin, Jr. ..... H02G 3/32 248/65
8,826,605 B2 9/2014 Recker et al.
D715,339 S 10/2014 Oetlinger
9,163,854 B2 * 10/2015 Arbucci ..... A47F 3/02
9,277,814 B2 3/2016 Winker
9,326,602 B2 5/2016 Gupta
9,458,619 B2 * 10/2016 Bowron ..... E04B 1/24
D772,775 S 11/2016 Bird et al.
9,528,271 B2 12/2016 Rook et al.
9,874,008 B2 * 1/2018 Doupe ..... E04B 1/2612
10,081,938 B2 * 9/2018 Acquistapace ..... E04B 1/2608
10,174,507 B1 * 1/2019 Henbid ..... E04B 1/34321
10,233,630 B1 3/2019 Francies, III
10,370,845 B2 3/2019 Francies, III
D851,482 S 6/2019 Ferman
D857,480 S 8/2019 Ryan
D857,483 S 8/2019 Bevier
D861,465 S 10/2019 Haider
10,480,197 B2 * 11/2019 Hohmann, Jr. ..... E04F 13/0857
10,597,865 B2 * 3/2020 Erlebach ..... A47K 3/40
D883,774 S 5/2020 Comalander
D885,868 S 6/2020 Hilmerson
D887,251 S 6/2020 Fox
D891,229 S 7/2020 Hohmann, Jr. et al.
D891,230 S 7/2020 Fox
D895,403 S 9/2020 Fox
D904,170 S 12/2020 Francis
10,883,265 B2 1/2021 Kelly et al.
D920,081 S 5/2021 Peterson
11,091,923 B2 8/2021 Recker et al.
D939,331 S 12/2021 Comalander
2003/0131543 A1 7/2003 Hansort
2004/0050012 A1 * 3/2004 Pulkkanen ..... E04B 1/4121 52/704
2006/0207215 A1 9/2006 Bruno
2007/0137135 A1 * 6/2007 Shymkowich ..... E04G 15/061 52/741.1
2007/0175174 A1 8/2007 Bruno
2009/0057518 A1 3/2009 Russell
2011/0047895 A1 3/2011 Finch
2011/0079698 A1 4/2011 Pezzimenti
2013/0248671 A1 9/2013 Schleiermacher et al.
2018/0058082 A1 3/2018 Hansort

(56) References Cited

U.S. PATENT DOCUMENTS

| | | | | |
|---|---|---|---|---|
| 2018/0283012 | A1* | 10/2018 | Hohmann, Jr. ..... | E04F 13/081 |
| 2020/0141111 | A1 | 5/2020 | Kelly et al. | |

FOREIGN PATENT DOCUMENTS

| | | | | |
|---|---|---|---|---|
| CH | 305283 | | 2/1955 | |
| CH | 684240 | | 8/1994 | |
| DE | 120510 | | 12/1899 | |
| DE | 1222634 | | 8/1966 | |
| GB | 173031 | | 12/1921 | |
| GB | 605669 | | 7/1948 | |
| GB | 2031715 | | 4/1980 | |
| GB | 2170525 | | 8/1986 | |
| KR | 20170013455 | A * | 2/2017 | ..... E04B 1/215 |
| WO | WO 2009/114902 | | 9/2009 | |

OTHER PUBLICATIONS

U.S. Appl. No. 17/371,675, filed Jul. 9, 2021, Recker et al..

"Pipe Braces Brochure," SureBuilt Concrete Forms & Accessories, Mar. 26, 2019, 6 pages [retrieved online from: surebuilt-usa.com/docs/Tilt-Up-Pipe-Braces.pdf].

"Tilt-up Technical Manual," MeadowBurke, 2018, MBo418, 126 pages [retrieved online from: www.meadowburke.com/techmanuals/tilt.pdf].

Nafadi et al. "Ledge behavior and strength of long-span L-shaped beams," PCI Journal, Mar.-Apr. 2018, p. 50-66.

Facebook Rapid Lok, Date Visited: Apr. 18, 2022, Facebook, Date Available: Feb. 28, 2019, https://www.facebook.com/pg/MeadowBurke/ posts/ (Year: 2019).

* cited by examiner

CONNECTOR FOR PRECAST CONCRETE STRUCTURES

CROSS-REFERENCE TO RELATED APPLICATIONS

This application claims priority under 35 U.S.C. § 119(e) to U.S. Provisional Patent Application Ser. No. 62/985,441 filed on Mar. 5, 2020, which is incorporated herein in its entirety by reference.

FIELD

The present disclosure is directed to the assembly of precast concrete panels, and more specifically to connectors used to orient, position, and secure precast concrete panels and floor joists relative to each other.

BACKGROUND

Precast concrete panels and associated connectors are widely used in the construction industry. Traditional concrete structures are formed in place and on site, whereas precast concrete panels are poured and cured off site in a modern manufacturing facility before being transported to the building site. Precast concrete panels allow for better quality control and reduced costs since precast forms can be reused hundreds or thousands of times. The popularity of precast concrete panels has created a demand for efficient, cost-effective connectors and methods for joining multiple precast concrete panels and floor joists, beams, and other associated structural components.

Connectors can be used to secure precast concrete panels and floor joists together in a variety of predetermined positions and orientations. These connectors are incorporated into the precast concrete panel during construction of the panel, or alternatively, the connectors can be incorporated into the precast concrete panel after construction of the panel, for example, by fastening the connector to the panel. Generally, these connectors have a two-part design where a first part connects to a second part to secure two objects together, for example, a wall panel and a floor joist. Examples of prior art devices may be found in U.S. Pat. Nos. 2,053,873 and 6,494,639 and U.S. Publication No. 2018/0347179, which are incorporated herein in their entireties by reference. One issue with these connectors is the complex process to manufacture a first part and/or a second part. In one example, one part is made from several plates welded together where the welded joint has to bear at least some of the forces associated with supporting a precast concrete structure. Thus, the welded joint has to be substantial enough to provide enough safety margin to support the weight of the precast concrete structure. The joint between the plates may be welded prior to shipment to a construction site or welded on the construction site, but regardless this welding consumes time and resources and incurs costs.

SUMMARY

The above shortcomings and other needs are addressed by the various embodiments and configurations of the present disclosure. It is an objective of the present disclosure to provide a connector that rapidly and securely connects an attachment member to a receiving member where load forces are primarily transferred through physical structures and connections as opposed to through welded joints. It is a further objective of the present disclosure to produce, for instance, the attachment member with fewer welds to reduce the time, resources, and costs to produce the attachment member.

It is an aspect of embodiments of the present disclosure to provide an attachment member that has a horizontal plate with a pair of protrusions that transfers a load to two gusset plates. The horizontal plate extends between a first end and a second end, and a first protrusion is positioned at the first end and a second protrusion is positioned at the second end. To assemble the attachment member, the first protrusion is inserted into an aperture in a first gusset plate and the second protrusion is inserted into an aperture in a second gusset plate. The gusset plates are oriented vertically and have features that selectively connect the attachment member to a receiving member embedded in a precast concrete structure. When a support structure such as a floor joist is positioned on the horizontal plate, the protrusions of the horizontal plate transfer the load to the gusset plates, and then the load is transferred to the receiving member and first precast concrete structure. Since the protrusions transfer the load rather than any welded joint, the attachment member requires much less welding, which saves time, resources, and costs. However, some welds may be utilized to locate some components of the attachment member relative to each other and hold some components together so that the components can transfer loads rather than any welded joint.

It is a further aspect of embodiments of the present disclosure to provide an attachment member with a support that reinforces the horizontal plate when a load is imposed on the horizontal plate. The support can be a single piece of material that is bent to resist deflections in the horizontal plate and/or the support itself caused by a load imposed on the horizontal plate. The bends can define peaks and troughs of the support, and the support can be secured to the horizontal plate at a front edge and a back edge of the support. In various embodiments, the bends extend between gusset plates to resist any sagging of the horizontal plate due to a load on the horizontal plate. Moreover, the side edges of the support may abut the gusset plates to further resist any sagging. In addition, the support can have one or more apertures to accommodate one or more plug welds to secure the support to the horizontal plate.

It is an aspect of embodiments of the present disclosure to provide an attachment member with a vent aperture extending through the gusset plate to vent fluids out of an enclosed space formed between the support and the horizontal plate. In various embodiments, the support is welded to the horizontal plate, and toxic gases may be formed within an enclosed space between the horizontal plate and the support. Thus, the vent aperture allows gases to flow out of the enclosed space, and the attachment member does not retain any toxic gases from any manufacturing process.

One particular embodiment of the present disclosure is an attachment member for joining a precast concrete structure and a support structure, comprising a first gusset plate and a second gusset plate each having an aperture and each having a vertical orientation; a horizontal plate extending between a first end and a second end, wherein the first end has a first protrusion that extends into the aperture of the first gusset plate, and the second end has a second protrusion that extends into the aperture of the second gusset plate; and a support secured to a bottom surface of the horizontal plate, wherein the support has a multiple bends to increase a rigidity of the horizontal plate.

In some embodiments, the support is a single piece of material, and the multiple bends form a plurality of troughs and a plurality of peaks, and wherein the multiple bends are parallel to each other and extend between the first and second gusset plates. In various embodiments, a front edge and a back edge of the support are each welded to the horizontal plate, and side edges of the support abut inner surfaces of the first and second gusset plates. In some embodiments, each of the first gusset plate and the second gusset plate are welded at respective inner surfaces to the horizontal plate.

In various embodiments, an aperture width of the aperture of the first gusset plate is between approximately 30% and 70% of a gusset width of the first gusset plate. In some embodiments, a receiving member having a pair of apertures extending through a body of the receiving member, wherein at least one anchor extends away from a back surface of the receiving member to hold the receiving member in a precast concrete structure, and wherein a protrusion extending from the first gusset plate and a protrusion extending from the second gusset plate are configured to extend into the pair of apertures to selectively connect the first and second gusset plates to the receiving member where forces are transferred between a support structure on the horizontal plate and the precast concrete structure. In some embodiments, a midpoint of the aperture width is aligned with a midpoint of the plate width. In various embodiments, the attachment member further comprises a vent aperture extending through the first gusset plate, wherein the vent aperture allows venting of an enclosed space formed between the horizontal plate and the support. In some embodiments, an aperture height of the aperture of the first gusset plate is greater than a diameter of the vent aperture, and an offset between a lower edge of the aperture of the first gusset plate and a bottom surface of the first gusset plate is greater than the aperture height. In various embodiments, a height of the support is less than the offset between the lower edge of the aperture of the first gusset plate and the bottom surface of the first gusset plate.

Another particular embodiment of the present disclosure is a method of manufacturing an attachment member for joining a precast concrete structure and a support structure, comprising (i) inserting a first protrusion of a horizontal plate into an aperture of a first gusset plate; (ii) inserting a second protrusion of the horizontal plate into an aperture of a second gusset plate; (iii) welding the horizontal plate to an inner surface of the first gusset plate and to an inner surface of the second gusset plate; and (iv) welding a front edge and a back edge of a support to a bottom surface of the horizontal plate, wherein the support comprises at least one bend extending between the first and second gusset plates.

In some embodiments, the method further comprises (v) bending a continuous structure to form the support with the at least one bend, wherein the at least one bend defines at least one peak and at least one trough. In various embodiments, the method further comprises (vi) orienting the at least one bend of the support parallel with each other. In some embodiments, the method further comprises (vii) welding the support to the bottom surface of the horizontal support through an aperture located at the at least one trough. In various embodiments, the method further comprises (viii) welding a spreader bar between the first and second gusset plates.

A further particular embodiment of the present disclosure is a connector for joining a precast concrete structure and a support structure, comprising a receiving member having a pair of apertures extending through a body of the receiving member, wherein at least one anchor extends away from a back surface of the receiving member to hold the receiving member in a precast concrete structure; an attachment member, having: a first gusset plate and a second gusset plate each having an aperture and each having a protrusion, wherein the protrusions of the first and second gusset plates are selectively received in the pair of apertures to selectively connect the attachment member to the receiving member; and a horizontal plate extending between a first end and a second end, wherein the first end has a first protrusion that extends into the aperture of the first gusset plate, and the second end has a second protrusion that extends into the aperture of the second gusset plate, wherein the horizontal plate is configured to receive another precast concrete structure.

In some embodiments, the connector further comprises a support secured to a bottom surface of the horizontal plate to increase a rigidity of the horizontal plate. In various embodiments, the support is a single piece of material that has multiple bends to form a plurality of troughs and a plurality of peaks. In some embodiments, the connector further comprises a vent aperture extending through the first gusset plate and configured to vent fluids from an enclosed space between the horizontal plate and the support. In various embodiments, a diameter of the vent aperture is less than a height of the aperture of the first gusset plate. In some embodiments, an aperture width of the aperture of the first gusset plate is between approximately 30% and 70% of a gusset width of the first gusset plate, and a midpoint of the aperture is aligned with a midpoint of the gusset plate.

One particular embodiment of the present disclosure is an attachment member for joining a precast concrete structure and a support structure, comprising a first gusset plate and a second gusset plate each having an aperture and each having a vertical orientation; a horizontal plate extending between a first end and a second end, wherein the first end has a first protrusion that extends in a horizontal direction into the aperture of the first gusset plate, and the second end has a second protrusion that extends in the horizontal direction into the aperture of the second gusset plate; and a support secured to a bottom surface of the horizontal plate to increase a rigidity of the horizontal plate.

In some embodiments, the support is a single piece of material that has multiple bends to form a shape with a plurality of troughs and a plurality of peaks. In various embodiments, at least one trough of the plurality of troughs is welded to the bottom surface of the horizontal plate. In some embodiments, a front edge and a back edge of the support are each welded to the bottom surface of the horizontal plate. In various embodiments, each of the first gusset plate and the second gusset plate are welded at respective inner surfaces to the horizontal plate.

Another particular embodiment of the present disclosure is a method of manufacturing an attachment member for joining a precast concrete structure and a support structure, comprising (i) inserting a first protrusion of a horizontal plate into an aperture of a first gusset plate; (ii) inserting a second protrusion of the horizontal plate into an aperture of a second gusset plate; (iii) welding the horizontal plate to an inner surface of the first gusset plate and to an inner surface of the second gusset plate; and (iv) welding a front edge and a back edge of a support to a bottom surface of the horizontal plate, wherein the support comprises at least one bend between the front edge and the back edge.

In various embodiments, the support is a continuous structure with a plurality of bends that define at least one peak and one trough of the support. In some embodiments, the method further comprises (v) welding the support to the bottom surface of the horizontal support through an aperture in the support.

A further particular embodiment of the present disclosure is a connector system for joining a precast concrete structure and a support structure, comprising a receiving member having a pair of apertures extending through a body of the receiving member, wherein at least one anchor extends away from a back surface of the receiving member to hold the receiving member in a precast concrete structure; an attachment member, having a first gusset plate and a second gusset plate each having an aperture and each having a protrusion, wherein the protrusions of the first and second gusset plates are selectively received in the pair of apertures to selectively connect the attachment member to the receiving member; and a horizontal plate extending between a first end and a second end, wherein the first end has a first protrusion that extends into the aperture of the first gusset plate, and the second end has a second protrusion that extends into the aperture of the second gusset plate.

In various embodiments, the connector system further comprises a support secured to a bottom surface of the horizontal plate to increase a rigidity of the horizontal plate. In some embodiments, the support is a single piece of material that has multiple bends to form a shape with a plurality of troughs and a plurality of peaks. In various embodiments, at least one trough of the plurality of troughs is welded to the bottom surface of the horizontal plate.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements or components. Additional aspects of the present disclosure will become more readily apparent from the Detailed Description, particularly when taken together with the drawings. In addition, details about the present disclosure can be found in Appendices A and B, which are incorporated in their entireties by reference.

The above-described embodiments, objectives, and configurations are neither complete nor exhaustive. As will be appreciated, other embodiments of the disclosure are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and claims themselves.

BRIEF DESCRIPTION OF THE DRAWINGS

The accompanying drawings, which are incorporated in and constitute a part of the specification, illustrate embodiments of the disclosure and together with the Summary given above and the Detailed Description of the drawings given below, serve to explain the principles of these embodiments. In certain instances, details that are not necessary for an understanding of the disclosure or that render other details difficult to perceive may have been omitted. It should be understood, of course, that the disclosure is not necessarily limited to the particular embodiments illustrated herein. Additionally, it should be understood that the drawings are not necessarily to scale.

Figure 1:
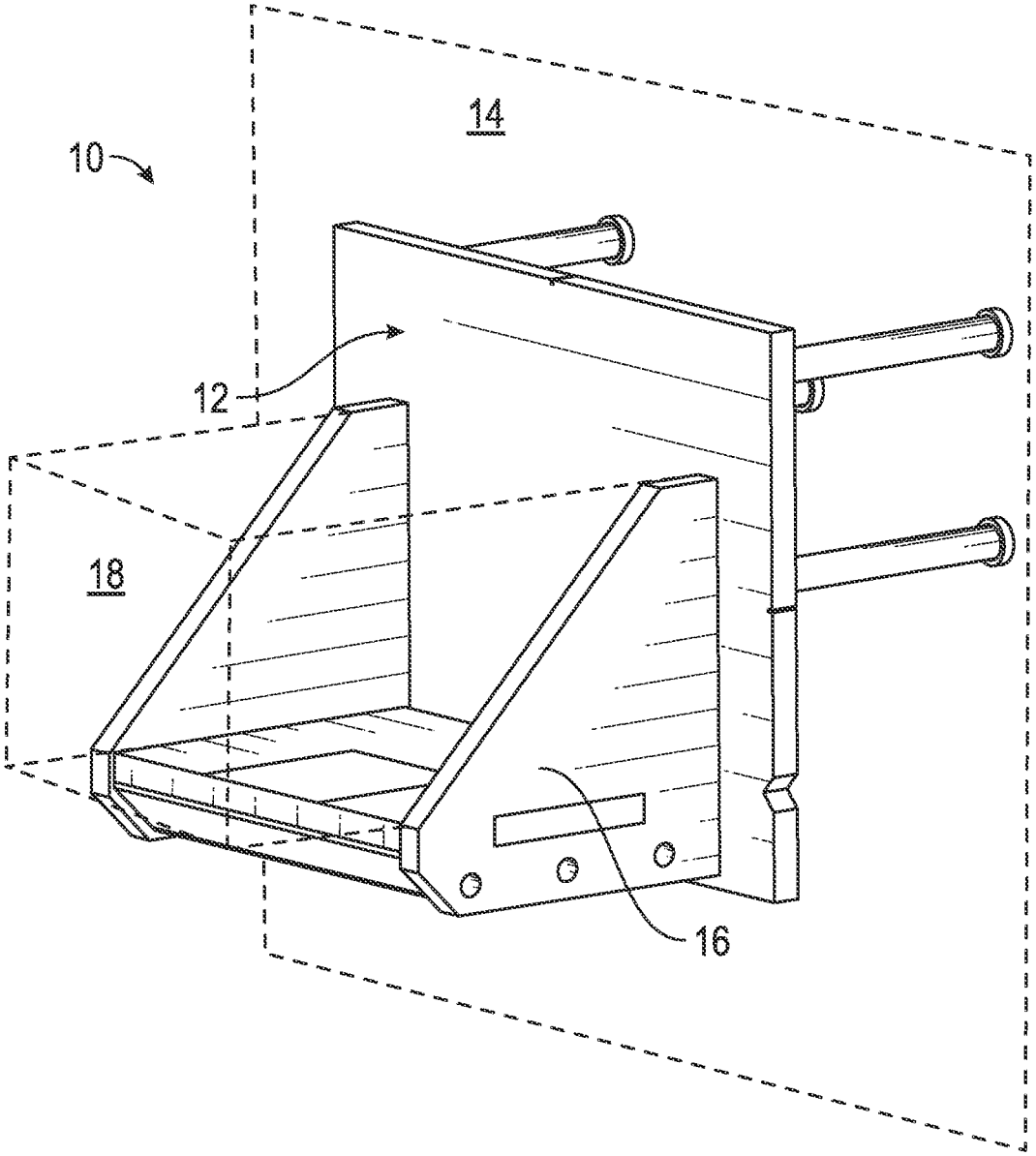
FIG. 1 is a perspective view of a connector system in accordance with an embodiment of the present disclosure.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 10 | Connector |
| 12 | Receiving Member |
| 14 | Concrete Structure |
| 16 | Attachment Member |
| 18 | Support Structure |
| 20 | Body |
| 22 | Anchor |
| 24 | First Aperture |
| 26 | Second Aperture |
| 28 | Gusset Plate |
| 30 | First Protrusion |
| 32 | Second Protrusion |
| 34 | Aperture |
| 36 | Horizontal Plate |
| 38 | Protrusion |
| 40 | Support |
| 42 | Inner Weld |
| 44 | Front Weld |
| 46 | Spreader Bar |
| 48 | Aperture Width |

-continued

| Number | Component |
|---|---|
| 50 | Plate Width |
| 52 | Centerline |
| 54 | Vertical Offset |
| 56 | Angle |
| 58 | Vent |
| 60 | Vent Offset |
| 62 | Aperture Height |
| 64 | Protrusion Width |
| 66 | Plate Width |
| 68 | Front Edge |
| 70 | Back Edge |
| 72 | Trough |
| 74 | Peak |
| 76 | Trough Interface |
| 78 | Enclosed Volume |
| 80 | Support Height |
| 82 | Insert Horizontal Plate into Gusset Plates |
| 84 | Weld Horizontal Plate to Gusset Plates |
| 86 | Weld Support to Horizontal Plate |
| 88 | Install Spreader Flat |

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed. To acquaint persons skilled in the pertinent arts most closely related to the present disclosure, a preferred embodiment that illustrates the best mode now contemplated for putting the disclosure into practice is described herein by, and with reference to, the annexed drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, may be modified in numerous ways within the scope and spirit of the disclosure.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present disclosure are described herein and as depicted in the drawings. It is expressly understood that although the figures depict a connector for precast concrete and/or other structures, the present disclosure is not limited to these embodiments.

Now referring to FIG. 1, a perspective view of a connector 10 is provided. The connector 10 generally comprises a receiving member 12 embedded in a precast concrete structure 14. An attachment member 16 can be selectively connected to the receiving member 12, and a support structure 18 can be positioned on the attachment member 16. Thus, the connector 10 joins the structures 14, 18. Although embodiments are described herein with respect to precast concrete structures and support structures such as floor joists, it will be appreciated that embodiments of the present disclosure encompass any concrete structures or any other structures that benefit from the connector 10 and methods of manufacturing the connector 10 described herein. Further exemplary embodiments of the connector 10 and components of the connector 10 are found in Appendix A and Appendix B, which are incorporated herein in their entireties by reference.

Figure 2:
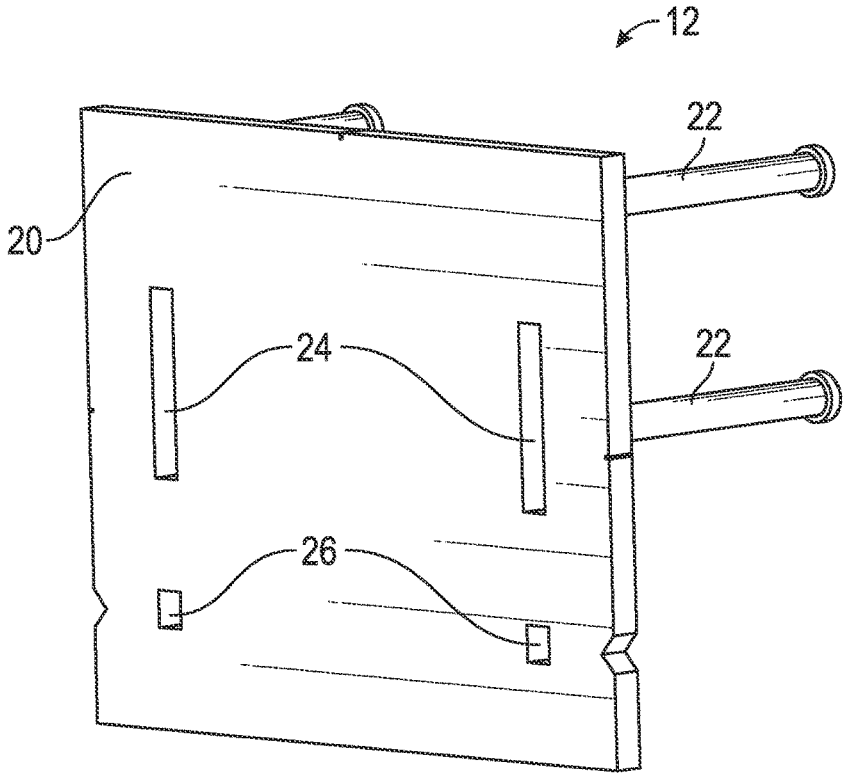
FIG. 2 is a perspective view of a receiving member in accordance with an embodiment of the present disclosure.

Now referring to FIG. 2, a perspective view of a receiving member 12 is provided. The receiving member 12 has a planar body 20, and one or more anchors 22 extend from a rear surface of the body 20 to embed the receiving member 12 in concrete. A pair of first apertures 24 and a pair of second apertures 26 extend through the body 20 to receive an attachment member. A void former or other similar device can be installed on the rear surface of the body 20 to define an enclosed space adjacent to one or more of the apertures 24, 26 to receive part of the attachment member. Additional details of an exemplary receiving member 12 and attachment member can be found in U.S. Publication No. 2018/0347179, which is incorporated herein in its entirety by reference.

Figure 3:
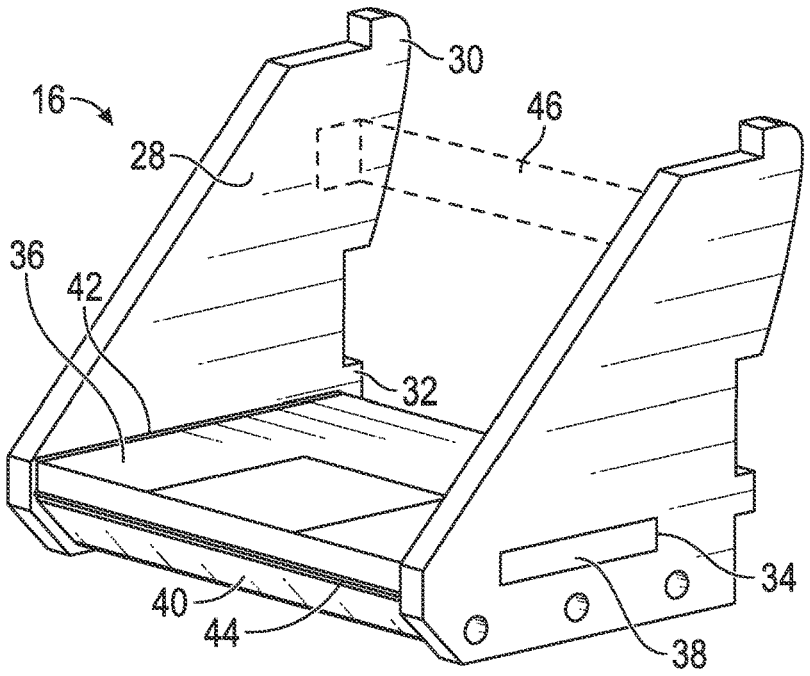
FIG. 3 is a perspective view of an attachment member in accordance with an embodiment of the present disclosure.

Now referring to FIG. 3, a perspective view of an attachment member 16 is provided. The attachment member 16 has two gusset plates 28, and a first protrusion 30 and a second protrusion 32 extend from a rear surface of each gusset plate 28. These protrusions 30, 32 extend through the apertures in the receiving member to selectively connect the attachment member 16 to the receiving member. In the embodiment in FIG. 3, each gusset plate 28 also has an aperture 34 extending through the body portion of each gusset plate 28, and protrusions 38 from a horizontal plate 36 extend into these apertures 34. When a support structure or other load is placed on an upper surface of the horizontal plate 36, the horizontal plate 36 transfers the forces to the gusset plates 28 through these protrusions 38 rather than any welded joint or other joint that relies on welding for transferring forces.

A support 40 is secured to a bottom surface of the horizontal plate 36 to add rigidity to the horizontal plate 36. In some embodiments, the support 40 is secured to the horizontal plate 36 with a weld 44 at a front edge of the support 40 and a weld at a back edge of the support. Moreover, another weld 42 can be used to secure the gusset plates 28 and the horizontal plate 36 to each other. These welds primarily hold the relative positions of the components, and the structure of the protrusion and aperture connection transfers forces from the horizontal plate 36 to the gusset plates 28.

FIG. 3 also shows an optional spreader bar 46 that is positioned between the gusset plates 28 to hold the upper ends of the gusset plates 28 at a predetermined distance from each other. The spreader bar 46 can be welded to each gusset plate 28 in some embodiments. In various embodiments, the spreader bar 46 has protrusions that extend into an aperture or recess on each gusset plate 28. Thus, the connection is similar to the connection between the horizontal plate 36 and the gusset plates 28.

Figure 4:
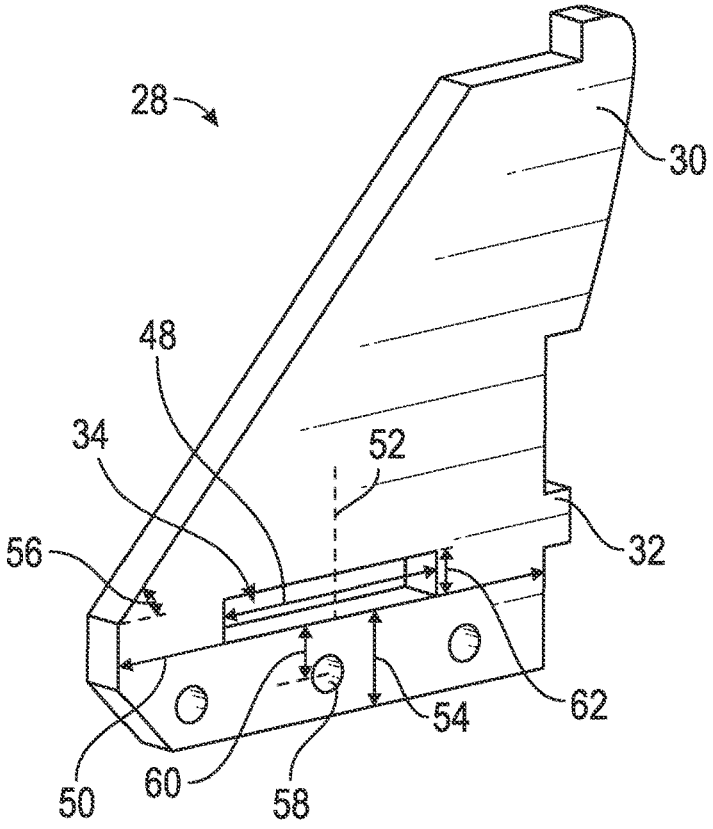
FIG. 4 is a perspective view of a gusset plate in accordance with an embodiment of the present disclosure.

Now referring to FIG. 4, a perspective view of a gusset plate 28 is provided. As shown, the aperture 34 through the gusset plate 28 has a rectangular cross section. A long side of the cross section can be described in terms relative to the width of the gusset plate 28 to sufficiently transfer forces from the protrusion of the horizontal plate to the gusset plate 28. Specifically, if the aperture 34 were too large relative to the width of the gusset plate 28, then the gusset plate 28 has less material to distribute load forces. Conversely, if the aperture 34 were too small relative to the width of the gusset plate 28, then the protrusion of the horizontal plate is small and may risk breaking or shearing away from the rest of the horizontal plate. Thus, in some embodiments, an aperture width 48 is between approximately 30% to 70% of a gusset width 50 from a front surface of the gusset plate 28 to a rear surface of the gusset plate 28. "Approximately" and/or "substantially" as described herein can mean a variation of +/−10% on a relative basis. In various embodiments, the aperture width 48 is approximately 50% of the gusset width 50. These relative terms and percentages allow the connector to distribute forces across a width of the aperture 34 without comprising the structural integrity of the gusset plate 28 or the horizontal plate. In some embodiments, the aperture width 48 is between approximately 3 and 5 inches. In various embodiments, the aperture width 48 is approximately 4 inches. In some embodiments, the gusset width 50 is between approximately 7 and 9 inches. In various embodiments, the gusset width 50 is approximately 8 inches. Moreover, in some embodiments, the centers 52 or midpoints of the aperture width 48 and the gusset width 50 are aligned to offset the aperture 34 from an outer edge of the gusset plate 28. If the aperture 34 is too close to the outer surface of the gusset plate 28, then only a thin portion of material may be relied upon to transmit load forces. Thus, to preserve the structure integrity of the gusset plate 28, the centers 52 are offset from each other by no more than +/−10% of the aperture width 48.

Other aspects of the gusset plate 28 can be characterized to preserve the structural integrity of the gusset plate 28. In some embodiments, a taper surface of the gusset plate 28 slopes in an upward and rearward direction at an angle 56 relative to a horizontal plane. This taper surface eliminates material and weight from the gusset plate 28. However, if the angle were too small or shallow, then the outer edge of the gusset plate 28 may extend too close to the aperture 34, which would leave only a small portion of material to transmit load forces, and the structural integrity of the gusset plate 28 would be jeopardized if subjected to a large load force. Thus, in some embodiments, the angle 56 is at least 35 degrees. In more preferable embodiments, the angle 56 is at least 40 degrees. In some embodiments, the angle 56 is approximately 45 degrees.

It will be further appreciated that while the aperture 34 is positioned near a bottom surface of the gusset plate 28 in FIG. 4, the aperture 34 can be positioned proximate to the top surface of the gusset plate 28 or any point between. In addition, the lower edge of the aperture 34 can be offset 54 from the bottom surface of the gusset plate 28 to preserve the integrity of the gusset plate 28 and also brace a support as described in further detail below. In some embodiments, the offset 54 is between approximately 1 and 2 inches. In various embodiments, the offset 54 is approximately 1.38 inches. In some embodiments, a slot can extend into the inner surface of the gusset plate 28 to receive a protrusion without completely extending through the body of the gusset plate 28.

Also shown in FIG. 4 are vent apertures 58 that extend through the gusset plate 28 and are aligned with enclosed spaces that are formed between the support and the horizontal plate as described in further detail below. When the support is welded or otherwise affixed to the horizontal plate and/or gusset plates 28, toxic gases can be created within these enclosed spaces. Thus, the vent apertures 58 allow those gases to escape. However, the vent apertures 58 are positioned to avoid negative effects on the structural integrity of the gusset plate. For instance, if the vent apertures 58 are positioned too close to the aperture 34, then only a small and insufficient portion of material may distribute a load force from the horizontal plate. Instead, the vent apertures 58 are depicted as having a circular cross-sectional shape with a diameter, and this diameter is smaller than a height 62 of the aperture 34. In turn, the height 62 of the aperture 34 is smaller than an offset 60 between the lower edge of the aperture 34 and a center of the vent aperture 58. This arrangement allows the vent apertures 58 to fulfill their venting functionality while not being positioned the vent apertures 58 too closely to the aperture 34 or sizing the vent apertures 58 too large to negatively affect the structural integrity of the gusset plate 28.

It will be appreciated that, in some embodiments, the vent aperture 58 has a diameter between approximately 0.25 and 1 inch. In various embodiments, the vent aperture 58 has a diameter of approximately 0.5 inches. In some embodiments, the height 62 of the aperture 34 is between approximately 0.5 to 1 inch. In various embodiments, the height 62 of the aperture 34 is approximately 0.66 inches. In some embodiments, the offset 60 is between approximately 0.5 and 1 inch. In various embodiments, the offset 60 is approximately 0.76 inches. In addition, three vent apertures 58 are depicted, which correspond to three enclosed spaces formed between the support and the horizontal plate. In addition, each gusset plate 28 has three apertures in some embodiments. However, it will be appreciated that each gusset plate may have fewer or greater than three vent apertures 58 to match the number of enclosed spaces between the support and the horizontal plate. Further, in various embodiments, only one gusset plate 28 has vent apertures 58.

Figure 5:
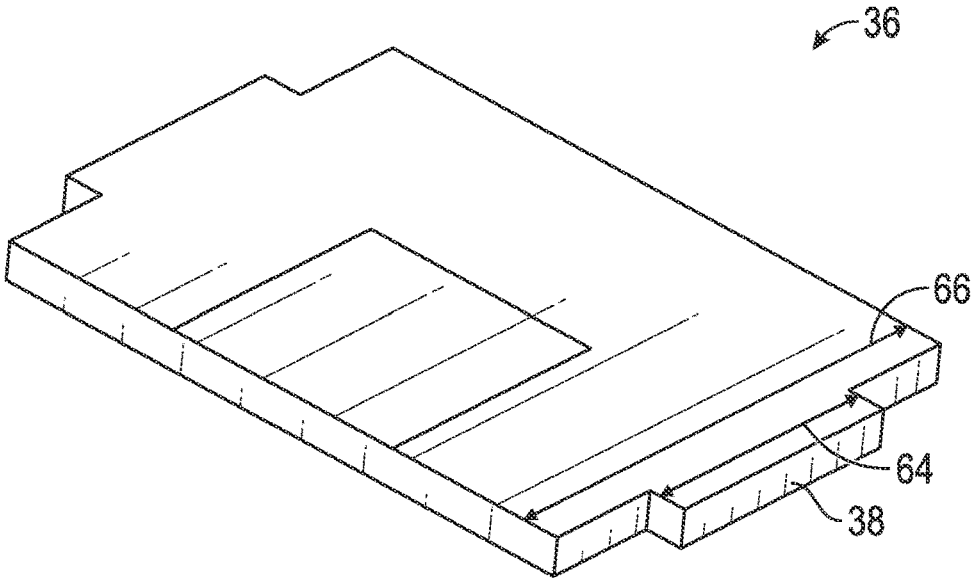
FIG. 5 is a perspective view of a horizontal plate in accordance with an embodiment of the present disclosure.

Now referring to FIG. 5, a perspective view of a horizontal plate 36 is provided. The horizontal plate 36 is ¾ inches thick in this embodiment, but it will be appreciated that embodiments of the present disclosure encompass a variety of plate thicknesses and shapes. The horizontal plate 36 extends between a first end and a second end with a protrusion 38 extending from each of these ends. The cross sectional shape of the protrusion 38 may correspond to the cross sectional shape of the aperture through the gusset plate, and the cross sectional shape of the protrusions 38 and apertures can include rectangular cross sections as well as other cross sectional shapes. The width of the protrusion 38 can be described in terms relative to the width of the horizontal plate. In some embodiments, a protrusion width 64 is between approximately 30% to 70% of a horizontal plate width 66. In various embodiments, the protrusion width 64 is approximately 50% of the horizontal plate width 66. In some embodiments, the protrusion width 64 is between approximately 3 and 5 inches. In various embodiments, the protrusion width 64 is approximately 4 inches. In some embodiments, the horizontal plate width 66 is between approximately 7 and 9 inches. In various embodiments, the horizontal plate width 66 is approximately 8 inches. Thus, the protrusion width 64 is substantially the same as the aperture width of the gusset plates, and the horizontal plate width 66 is substantially the same as the gusset width of the gusset plates. Like the apertures in the gusset plates, the width of the protrusion distributes forces received from a load on the horizontal plate 36 to the gusset plates without compromising the structural integrity of the horizontal plate 36 or the gusset plates. Further still, the protrusions 38 are centered along the width of the horizontal plate 36 like the apertures in the gusset plates. In various embodiments, a midpoint of the protrusion 38 is positioned within +/−10% of the midpoint of the horizontal plate 36 in the width direction.

Figure 6:
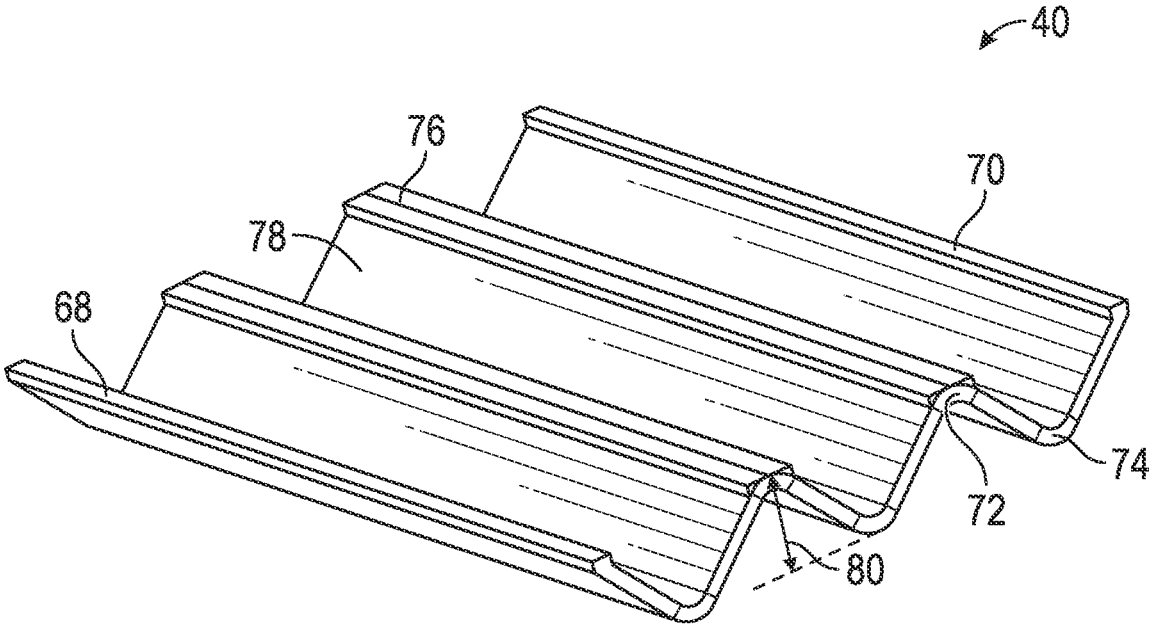
FIG. 6 is a perspective view of a support in accordance with an embodiment of the present disclosure.

Now referring to FIG. 6, a perspective view of a support 40 that adds rigidity to the horizontal plate is provided. The support 40 in this embodiment is made from a single piece of material that has several bends to form at least one trough 72 and at least one peak 74. In some embodiments, a front edge 68 and a back edge 70 of the support 40 are welded to the horizontal plate, and flat surfaces 76 at the troughs 72 provide a stable interface with the horizontal plate. In various embodiments, one or more of the troughs 72 are welded to the bottom surface of the horizontal plate. As shown in the Appendices, the support 40 can have one or more apertures at the troughs 72, and a plug weld in each of these apertures secures the support 40 to the horizontal plate.

The bends, the troughs 72, and the peaks 74 resist deflection through a planar direction of the support 40, i.e., a direction from top to bottom in FIG. 6. Specifically, since the protrusions of the horizontal plate transfer load forces, there is a tendency for the horizontal plate to sag between the protrusions. Thus, in various embodiments, the bends that form the troughs 72 and peaks 74 are parallel with each other and oriented between the protrusions. As a result, the support 40 resists the sagging between the protrusions of the horizontal plate. In addition, the gusset plates themselves can resist the sagging of the horizontal plate where the side edges of the support 40 abut the gusset plates, and a height 80 of the support 40 between the troughs 72 and peaks 74 is less than an offset between a lower edge of the aperture in the gusset and the bottom surface of the gusset as described above. Thus, as the center of the horizontal plate sags, the inner surfaces of the gusset plates fully contact and brace the side edges of the support 40 to resist the sagging.

The abutting relationship between the gusset plates and the support 40 can create encloses spaces 78 generally defined between the support 40 and the horizontal plate. As described above, vent apertures in the gusset plates can address the issue of any toxic gases retained in these spaces 78. Moreover, it will be appreciated that embodiments of the support 40 can have a single peak 74 or multiple peaks 74. It will be appreciated that in some embodiments, the support can simply be a reinforcing plate secured to the horizontal plate. Further still, the horizontal plate can have an increased size to resist deflection without the use of a support.

Figure 7:
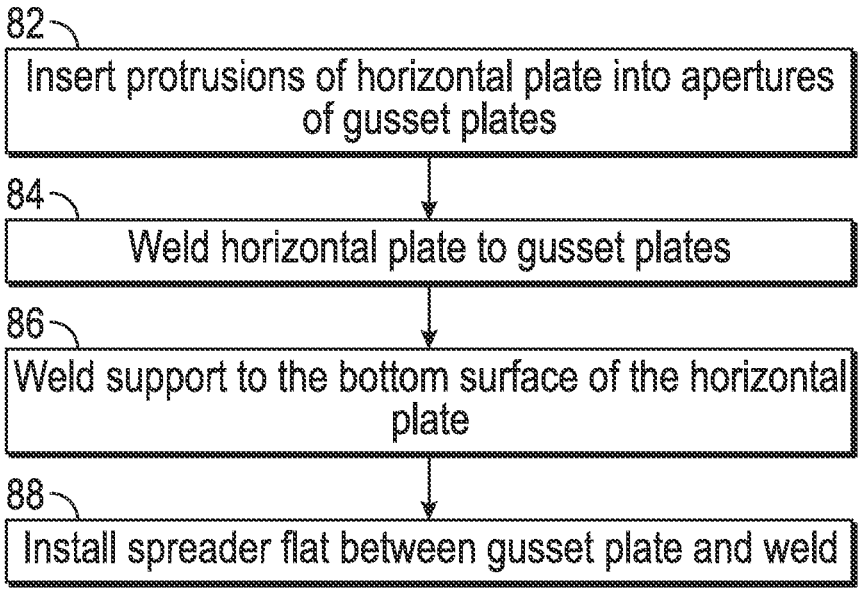
FIG. 7 is a flowchart for assembling a connector system in accordance with an embodiment of the present disclosure.

Now referring to FIG. 7, a flow chart for a method of assembling or manufacturing a connector is provided. First, the protrusions of the horizontal plate are inserted 82 into the corresponding apertures in the gusset plates. In some embodiments, the horizontal plate and the gusset plates are welded together 84 to secure the relative positions of these components even though the protrusions transfer forces from the horizontal plate to the gusset plates. Next, a support is welded 86 or otherwise secured to a bottom surface of the horizontal plate to add rigidity to the horizontal plate. Finally, a spreader flat is optionally installed 88 between a gusset plate and a weld. The spreader flat can extend between the upper ends of the gusset plates, for example, to hold the relative spacing between the gusset plates.

The description of the present disclosure has been presented for purposes of illustration and description, but is not intended to be exhaustive or limiting of the disclosure to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

While various embodiments of the present disclosure have been described in detail, it is apparent that modifications and alterations of those embodiments will occur to those skilled in the art. Moreover, references made herein to "the present disclosure" or aspects thereof should be understood to mean certain embodiments of the present disclosure and should not necessarily be construed as limiting all embodiments to a particular description. It is to be expressly understood that such modifications and alterations are within the scope and spirit of the present disclosure, as set forth in the following claims.

What is claimed is:

1. An attachment member for joining a precast concrete structure and a support structure, comprising:

a first gusset plate and a second gusset plate each having an aperture and each having a vertical orientation;

a horizontal plate extending between a first end and a second end, wherein said first end has a first protrusion that extends into said aperture of said first gusset plate, and said second end has a second protrusion that extends into said aperture of said second gusset plate; and a support secured to a bottom surface of said horizontal plate, wherein said support has a multiple bends to increase a rigidity of said horizontal plate.

2. The attachment member of claim 1, wherein said support is a single piece of material, and said multiple bends form a plurality of troughs and a plurality of peaks, and wherein said multiple bends are parallel to each other and extend between said first and second gusset plates.

3. The attachment member of claim 1, wherein a front edge and a back edge of said support are each welded to said horizontal plate, and side edges of said support abut inner surfaces of said first and second gusset plates.

4. The attachment member of claim 1, wherein each of said first gusset plate and said second gusset plate are welded at respective inner surfaces to said horizontal plate.

5. The attachment member of claim 1, wherein an aperture width of said aperture of said first gusset plate is between approximately 30% and 70% of a gusset width of said first gusset plate.

6. The attachment member of claim 1, further comprising:

a receiving member having a pair of apertures extending through a body of said receiving member, wherein at least one anchor extends away from a back surface of said receiving member to hold said receiving member in a precast concrete structure, and wherein a protrusion extending from said first gusset plate and a protrusion extending from said second gusset plate are configured to extend into said pair of apertures to selectively connect said first and second gusset plates to said receiving member where forces are transferred between a support structure on said horizontal plate and said precast concrete structure.

7. The attachment member of claim 1, further comprising a vent aperture extending through said first gusset plate, wherein said vent aperture allows venting of an enclosed space formed between said horizontal plate and said support.

8. The attachment member of claim 7, wherein an aperture height of said aperture of said first gusset plate is greater than a diameter of said vent aperture, and an offset between a lower edge of said aperture of said first gusset plate and a bottom surface of said first gusset plate is greater than said aperture height.

9. The attachment member of claim 8, wherein a height of said support is less than said offset between said lower edge of said aperture of said first gusset plate and said bottom surface of said first gusset plate.

10. A method of manufacturing an attachment member for joining a precast concrete structure and a support structure, comprising:

inserting a first protrusion of a horizontal plate into an aperture of a first gusset plate;

inserting a second protrusion of said horizontal plate into an aperture of a second gusset plate;

welding the horizontal plate to an inner surface of said first gusset plate and to an inner surface of said second gusset plate; and welding a front edge and a back edge of a support to a bottom surface of said horizontal plate, wherein said support comprises at least one bend extending between said first and second gusset plates.

11. The method of claim 10, further comprising bending a continuous structure to form said support with said at least one bend, wherein said at least one bend defines at least one peak and at least one trough.

12. The method of claim 11, further comprising orienting said at least one bend of said support parallel with each other.

13. The method of claim 11, further comprising welding said support to said bottom surface of said horizontal support through an aperture located at said at least one trough.

14. The method of claim 10, further comprising welding a spreader bar between said first and second gusset plates.

15. A connector for joining a precast concrete structure and a support structure, comprising:

a receiving member having a pair of apertures extending through a body of said receiving member, wherein at least one anchor extends away from a back surface of said receiving member to hold said receiving member in a precast concrete structure;

an attachment member, having:

a first gusset plate and a second gusset plate each having an aperture and each having a protrusion, wherein said protrusions of said first and second gusset plates are selectively received in said pair of apertures to selectively connect said attachment member to said receiving member; and a horizontal plate extending between a first end and a second end, wherein said first end has a first protrusion that extends into said aperture of said first gusset plate, and said second end has a second protrusion that extends into said aperture of said second gusset plate, wherein said horizontal plate is configured to receive a support structure.

16. The connector of claim 15, further comprising a support secured to a bottom surface of said horizontal plate to increase a rigidity of said horizontal plate.

17. The connector of claim 16, wherein said support is a single piece of material that has multiple bends to form a plurality of troughs and a plurality of peaks.

18. The connector of claim 16, further comprising a vent aperture extending through said first gusset plate and configured to vent fluids from an enclosed space between said horizontal plate and said support.

19. The connector of claim 18, wherein a diameter of said vent aperture is less than a height of said aperture of said first gusset plate.

20. The connector of claim 15, wherein an aperture width of said aperture of said first gusset plate is between approximately 30% and 70% of a gusset width of said first gusset plate, and a midpoint of said aperture is aligned with a midpoint of said gusset plate.

* * * * *